US009945138B1

(12) United States Patent
Cahoon

(10) Patent No.: US 9,945,138 B1
(45) Date of Patent: Apr. 17, 2018

(54) VERTICAL REVERSIBLE ONE PIECE GUARD RAIL POST

(71) Applicant: Michael P. Cahoon, Corpus Christi, TX (US)

(72) Inventor: Michael P. Cahoon, Corpus Christi, TX (US)

( * ) Notice: Subject to any disclaimer, the term of this patent is extended or adjusted under 35 U.S.C. 154(b) by 0 days.

(21) Appl. No.: 15/635,841

(22) Filed: Jun. 28, 2017

(51) Int. Cl.
*E04H 17/20* (2006.01)
*E04G 21/32* (2006.01)
*E04H 17/14* (2006.01)

(52) U.S. Cl.
CPC ..... *E04G 21/3204* (2013.01); *E04H 17/1421* (2013.01); *E04H 17/20* (2013.01); *E04H 2017/1465* (2013.01)

(58) Field of Classification Search
CPC ..... E04H 17/20; E04H 17/22; E04H 17/1421; E04H 17/1434; E04G 21/3204; E04G 21/3223; E04G 21/3219
See application file for complete search history.

(56) References Cited

U.S. PATENT DOCUMENTS 3,468,430 A * 9/1969 Lawman ..... A47F 5/14 211/182
3,902,703 A * 9/1975 Bouye ..... E04H 17/1426 256/19
3,905,483 A * 9/1975 Patrick ..... A47F 5/10 211/190
4,177,968 A * 12/1979 Chapman ..... E04C 3/07 249/211
4,542,885 A * 9/1985 Rossiter ..... E04H 17/1413 256/55
4,918,899 A * 4/1990 Karytinos ..... E04B 1/24 403/230
4,979,725 A * 12/1990 Hutchings, II ..... E04G 5/06 182/82
5,601,278 A * 2/1997 Graber ..... E04H 17/143 256/19
6,199,336 B1 * 3/2001 Poliquin ..... E04B 2/58 52/261
6,701,689 B2 * 3/2004 diGirolamo ..... E04B 2/7457 52/243
6,854,237 B2 * 2/2005 Surowiecki ..... E04B 2/7457 403/230
7,017,310 B2 * 3/2006 Brunt ..... E04B 2/7457 174/66

(Continued)

*Primary Examiner* — Daniel J Wiley
(74) *Attorney, Agent, or Firm* — M. Susan Spiering; Ferrell's PLLC

(57) ABSTRACT

Disclosed is a safety barrier system for use at construction sites. An inventive, simple to use, reusable, efficient to assemble and disassemble safety guard rail system for use in construction of multistory structures, primarily multistory apartment complexes is described. The inventive system allows for common 2"×4" or 2"×6" wooden posts to be used for a railing system. The system includes a single reversible centerline safety rail, or guard rail post having apertures on its central region, and keyholes along the folded edges thereof. The post may be installed on any horizontal or vertical surface that is usually above the ground. In operation, the guard rail post is mounted on a flat surface, such that a keyhole engages with a fastener attached to the flat surface. Guard rails are received in the apertures formed on the support plate to create a safety rail arrangement.

15 Claims, 11 Drawing Sheets

(56) References Cited

U.S. PATENT DOCUMENTS

| | | | | |
|---|---|---|---|---|
| 7,571,897 | B2 * | 8/2009 | Heinz | E04H 17/16 256/65.03 |
| 8,016,137 | B2 * | 9/2011 | Shaha | A47B 96/061 211/103 |
| 8,382,070 | B1 * | 2/2013 | Gibbs | E04H 17/1434 256/65.02 |
| 8,424,266 | B2 * | 4/2013 | Edmondson | E04B 2/7412 52/650.1 |
| 9,010,070 | B2 * | 4/2015 | Darr, III | E04B 2/7457 52/481.1 |
| 2004/0041141 | A1 | 3/2004 | Cannon | |
| 2006/0191236 | A1 * | 8/2006 | Surowiecki | E04B 2/763 52/481.1 |
| 2006/0249721 | A1 | 11/2006 | Landaker | |
| 2009/0159865 | A1 | 6/2009 | Carvalho | |
| 2009/0178369 | A1 * | 7/2009 | Pilz | E04B 1/24 52/781.3 |

* cited by examiner

VERTICAL REVERSIBLE ONE PIECE GUARD RAIL POST

FIELD OF THE INVENTION

The present invention relates to a safety barrier system for use at construction sites. In particular, the invention relates to a safety rail post that provides fall protection for people working on or near the edges of elevated surfaces at the construction sites.

DESCRIPTION OF THE RELATED ART

During construction of buildings, it is desirable to provide a safety rail system to protect workers who may slide off or fall from the drop-off edges of the upper floors. Construction articles, such as tools and workpieces can get dislodged from the drop-off edges of the floor or slide therefrom due to careless handling. Thus, the floors with no surrounding walls pose danger to the workers working under the drop-off edges of the upper floors. Hence, for the safety of the workers, equipment such as safety barriers and guard rails are installed at the edge of open structures. The safety barriers and guard rails are also installed at the window openings and stairwell openings to prevent workers from accidentally falling off the stairwell and windows and incurring injuries. An example of the safety equipment includes use of a top guard rail at about waist height to provide support to workers and prevent them (or equipment) from falling down, a middle guard rail for additional support and strength to the safety rail system, and a bottom guard rail or the kick-board rail erected at floor level so as to prevent the accidental dislodgement of articles. The guard rails can be made of metal or wood. Generally, various lengths of lumber stock such as long boards of the 2"×4" variety (commonly referred to as "two-by-fours") are used as guard rails. The safety equipment has to be in compliance with safety procedures of organizations, such as Occupational Safety and Health Administration (OSHA).

Another conventional safety system includes use of a base plate attached to the floor at the drop-off edge using a set of screws. An upright column is connected to the base plate, which includes one or more brackets for holding the guard rails. The system can further include support rods for providing additional support to the upright column. Once the railings have served their purpose, they are knocked down. The longer boards are reserved for future use. The shorter boards are seldom reusable and are disposed of. Further, the brackets that hold the guard rails get damaged easily due to wear and tear, leading to dislodgement of the guard rails. Such safety systems involving the use of base plate are complex in construction.

The conventional safety systems use lag bolts to install the steel safety railing systems to vertical walls. Frequently, workers use their framing hammer to drive-in the lag bolts, thereby significantly reducing the strength of these systems. Additionally, such systems require the workers to lean out in keeling position to remove the posts. Sometimes, if a worker of average height leans on the railing, the center of gravity would be over the edge of the building and the weight would serve to topple over the safety barrier. This makes such systems hazardous. Further, some systems affix only to a horizontal surface and can only be installed once the floor sheeting is installed. Scissor lift type systems are also common, but they are not practical for workers. They are often used improperly, leading to dangerous working conditions.

U.S. Pub. No 2006/0249721 by Greg et. al., discloses a temporary safety rail that includes an elongate tubular member and a shoe plate secured to lower end of the elongate tubular member. A pair of rail support boxes is mounted on the elongate tubular member. The pair of rail support boxes is adapted to receive the guard rails. The shoe plate of the temporary safety rail has to be nailed to install it at a desired position. Hence, the temporary rail support cannot be moved or disassembled easily when required. Further, the invention has limited use, as the shoe plate is fastened to the surface, which limits the erection of walls atop the surface.

U.S. Pub. No 2004/0041141 by Douglas discloses a safety guard rail apparatus that includes a base fitting that is removably engaged with a lower portion of an upright post. A middle rail fitting is removably engaged with a medial portion of the upright post and further removably engaged with a horizontal middle rail. A top rail fitting is removably engaged with an upper portion of the upright post and further removably engaged with a horizontal top rail. The base, middle rail, and top rail fittings are engaged with the upright post, the middle rail, and the top rail using fasteners, such as nails or screws. A corner fitting receives an end portion of the horizontal middle rails or top rails. In this manner, a temporary guard rail system may be constructed around elevated construction sites for worker's safety. To remove the top rail, the fasteners between the top fitting and the top rail, and the fasteners between the upright post and the top fitting are to be pried out, which is a cumbersome process.

U.S. Pub. No 2009/0159865 by Joseph discloses a reusable temporary safety post that includes an upright stanchion, angular railing brackets, and a bottom bracket arrangement. Once installed, the reusable temporary safety posts can be linked together using lumber rails, which fit into the angular railing brackets provided on the upright stanchions. The lumber rails are secured in place using nails or wood screws inserted through a hole provided in the angular railing brackets. The bottom bracket arrangement is adapted to fit over upper edge or header of a floor wall.

Safety rail supports disclosed in above patents require a great deal of time for assembling and disassembling. Also, the design of the safety rail supports is such that a person must be aware of the right orientation of the safety rail post at the time of use. The current safety rail supports comprise numerous independent components that increase their complexity and weight, and require boltings to be placed beneath the flooring structure. Further, the safety rail supports are mounted to elevated surfaces using nails or lag screws. To disassemble the safety rail supports from the elevated surfaces, the nails are to be pried-out by the worker. This procedure of disassembling the safety rail supports is dangerous and time consuming to the worker as the worker must lean over edges of the elevated surfaces to pry out the nails. The components of the safety rails entail the risk of getting damaged during prying-out of the nails. Furthermore, the complicated procedure for setting up and dissembling of the safety rails affects the mobility of large items that are carried inside the construction site, as the safety rails have to be disassembled before carrying such items.

In light of the foregoing, there exists a need for a safety rail post that is simple in construction, portable, reusable, and effective in preventing accidental falls. The safety rail post should not only meet the required safety standards but should also be assembled and disassembled in an efficient manner. Finally, the safety rail post should reduce the labor and material costs.

SUMMARY

Disclosed herein is an inventive simple to use, reusable, efficient to assemble and disassemble safety guard rail system for use in construction of multistory structures, primarily multistory apartment complexes. However, it is usable with other any type of buildings or uses where a safety railing is recommended. The inventive system allows for common 2"×4" or 2"×6" wooden rails to be used for a railing system as a "balcony-type" safety structure. The system may be installed on any horizontal or vertical surface that is above the ground, and may be used where OSHA safety regulations require a safety barrier. The inventive system may also be used where no OSHA regulations reside.

The guard rail post is fabricated as one piece having strategically placed holes (described further below) on the edgings as keyholes, and in the central plate region have lightening, circular, and rectangular holes. The rectangular holes are used for placement of the 2"×4" or 2"×6" boards. The 2"×4" or 2"×6" rail boards may be wooden, metal, sturdy plastic, or any suitable material for forming a safety barrier for a worker. Preferably, and most simply, wooden boards are used, and the invention is described as such.

In an embodiment, a guard rail post includes a longitudinally extending support plate, essentially the central portion of the post. A first post mount perpendicularly extends from a first side of the support plate and includes a plurality of keyholes formed thereon, essentially the keyholes are along a folded edge of the central portion. A second post mount perpendicularly extends from a second side of the support plate and optionally includes a plurality of keyholes formed thereon; keyholes placed on the opposite folded edge of the post. The first and second post mounts extend longitudinally throughout a length of the (central portion) support plate. First and second anti-twist return supports extend perpendicularly and inwardly from the first and second post mounts. First and second anti-twist lip supports extend perpendicularly and inwardly from the first and second anti-twist return supports. The support plate includes at least one aperture formed thereon. In operation, the guard rail post is vertically or horizontally mounted on a flat surface, such that at least one keyhole of at least one of the first and second post mounts engages with at least one fastener attached to the flat surface. At least one of the first and second post mounts are in contact with the flat surface. Finally, at least one guard rail is received in the at least one aperture formed on the support plate. The preferred design utilizes the keyhole mounting feature that provides for easy, safe assembly and even faster disassembly that is beneficial to the workers.

The guard rail post of the safety rail system prevents accidental falls. Moreover, the guard rail post is simple in construction, portable, and reusable. The guard rail post is easy to setup and disassemble in less time with minimum efforts. The guard rail post is made of a single metal component and it requires less material to manufacture and reduces labor cost for setting it up.

BRIEF DESCRIPTION OF THE DRAWINGS

The accompanying drawings illustrate the various embodiments of systems, methods, and other aspects of the invention. It will be apparent to a person skilled in the art that the illustrated element boundaries (e.g., boxes, groups of boxes, or other shapes) in the figures represent one example of the boundaries. In some examples, one element may be designed as multiple elements, or multiple elements may be designed as one element. In some examples, an element shown as an internal component of one element may be implemented as an external component in another, and vice versa.

Various embodiments of the present invention are illustrated by way of example, and not limited by the appended figures, in which like references indicate similar elements, and in which.

Further areas of applicability of the present invention will become apparent from the detailed description provided hereinafter. It should be understood that the detailed description of exemplary embodiments is intended for illustration purposes only and is, therefore, not intended to necessarily limit the scope of the present invention.

DETAILED DESCRIPTION OF EMBODIMENTS

As used in the specification and claims, the singular forms "a", "an" and "the" include plural references unless the context clearly dictates otherwise. For example, the term "an article" may include a plurality of articles unless the context clearly dictates otherwise.

Those with ordinary skill in the art will appreciate that the elements in the Figures are illustrated for simplicity and clarity and are not necessarily drawn to scale. For example, the dimensions of some of the elements in the Figures may be exaggerated, relative to other elements, in order to improve the understanding of the present invention.

There may be additional components described in the foregoing application that are not depicted on one of the described drawings. In the event, such a component is described, but not depicted in a drawing, the absence of such a drawing should not be considered as an omission of such design from the specification.

Before describing the present invention in detail, it should be observed that the present invention utilizes a combination of system components which constitutes a guard rail post. Accordingly, the components and the method steps have been represented, showing only specific details that are pertinent for an understanding of the present invention so as not to obscure the disclosure with details that will be readily apparent to those with ordinary skill in the art having the benefit of the description herein.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Figure 1A:
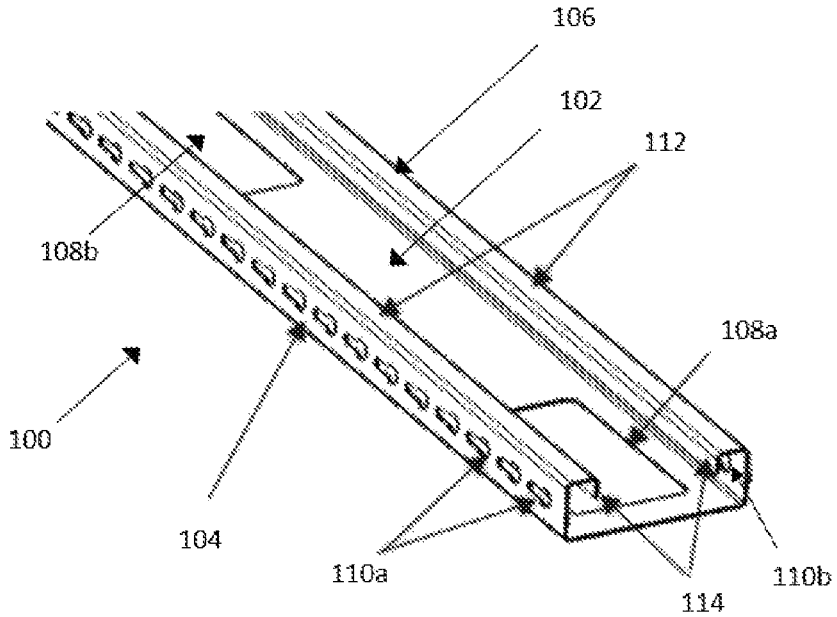
FIG. 1A is an isometric view of a guard rail post, in accordance with an embodiment of the present invention.

FIG. 1A illustrates a guard rail post 100 that may be used in a safety rail system installed at an elevated surface of a building or a construction site to prevent workers from falling off edges of the elevated surface. The guard rail post 100 includes a longitudinally extending support plate 102 having two sides, viz. a first side and a second side. The guard rail post 100 further includes first and second post mounts 104 and 106 that perpendicularly extend from the first and second sides of the support plate 102, respectively. The support plate 102, and the first and second post mounts 104 and 106 extend longitudinally to form a U-shape when viewed in a transverse cross-section. The support plate 102 has a set of apertures 108 formed thereon for receiving guard rails (not shown) of the safety rail system. The set of apertures 108 includes first through sixth apertures 108*a*-108*f*. It should be noted that in FIG. 1A, the first and second apertures 108*a*-108*b* are shown for illustrative purpose only and any suitable number of apertures may be formed without departing from scope and spirit of the present invention. For example, there may be formed four or five apertures instead of six as illustrated herein, or greater than six if needed or desired.

The first post mount 104 and second post mount 106 have a first plurality of keyholes 110*a* and a second plurality of keyholes 110*b*, respectively, formed thereon for allowing the guard rail post 100 to engage with fasteners, such as nails, screws, or bolts. The guard rail post 100 includes first and second anti-twist return supports 112*a* and 112*b* (collectively referred to as "anti-twist return supports 112") that extend perpendicularly and inwardly from the first and second post mounts 104 and 106, respectively. The guard rail post 100 further includes first and second anti-twist lip supports 114*a* and 114*b* (collectively referred to as "anti-twist lip supports 114") that extend perpendicularly and inwardly from the first and second anti-twist return supports 112*a* and 112*b*, respectively. The first and second anti-twist lip supports 114*a* and 114*b* provide a counter support to prevent the guard rails from tilting or twisting in the set of apertures 108. By virtue of the U-shape cross section, two guard rail posts of the present invention can be conveniently stored in less space, by engaging them against each other.

Figure 1B:
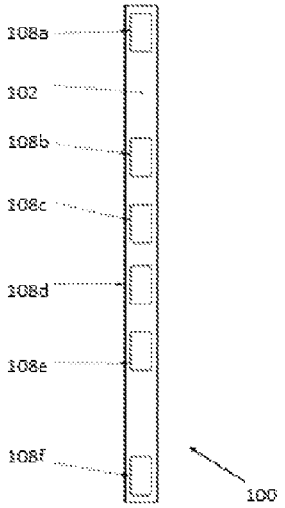
FIG. 1B is a rear view of the guard rail post, in accordance with an embodiment of the present invention.

FIG. 1B illustrates a rear view of the guard rail post 100 with the first through sixth apertures 108*a*-108*f*. The first aperture 108*a* is formed at a top portion of the support plate 102. The second through fifth apertures 108*b*-108*e* are formed symmetrically at a middle portion of the support plate 102. The second through fifth apertures 108*b*-108*e* are spaced apart from each other along a longitudinal direction of the support plate 102. The sixth aperture 108f is formed at a bottom portion of the support plate 102. The first through sixth apertures 108*a*-108*f* are arranged symmetric about a center of the guard rail post 100. In an embodiment, each aperture of the first through sixth apertures 108*a*-108*f* is rectangular in shape. Moreover, each aperture of the first through sixth apertures 108*a*-108*f* can be formed at uneven intervals on the support plate 102 without departing from scope and spirit of the present invention. Each aperture of the first through sixth apertures 108*a*-108*f* is capable of receiving a guard rail. The guard rails are horizontal lumber stocks, such as long boards. The guard rails may be made of suitable materials, such as aluminum, steel, or wood. Traditionally, long boards of 2"×4" and/or 2"×6" varieties are used as the guard rails. Further, the placement of the apertures 108 can be made compliant with OSHA regulations, section 1926.502(b).

Figure 1C:
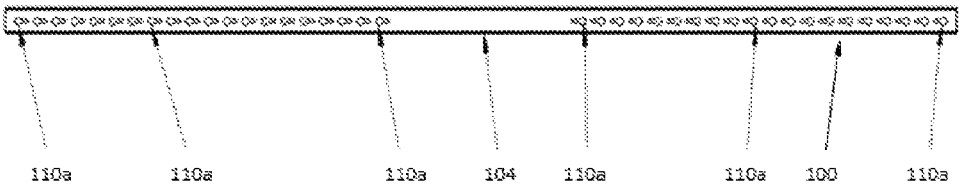
FIG. 1C is a side view of the guard rail post, in accordance with an embodiment of the present invention.

FIG. 1C illustrates a side view of the guard rail post 100 with the first plurality of keyholes 110*a*. The first plurality of keyholes 110*a*, spaced apart from each other along a longitudinal direction of the first post mount 104, are formed symmetrically about both ends of the first post mount 104. In an embodiment, the distance between two keyholes of the first set of keyhole openings 110*a* is of 1.5 inches. Similarly, the second plurality of keyholes 110*b*, spaced apart from each other along a longitudinal direction of the second post mount 106, are formed symmetrically about both ends of the second post mount 106. The first plurality of keyholes 110*a* and the second plurality of keyholes 110*b* allow the installation of the guard rail post 100 on a flat surface. The guard rail post 100 is vertically (or horizontally) mounted on a flat surface by engaging a keyhole 110 with a fastener attached to the flat surface. This arrangement allows one of the first and second post mounts 104 and 106 to be in contact with the flat surface and secures the guard rail post 100 to the flat surface at ease. The keyholes 110 allow the guard rail post 100 to secure onto various flat surfaces, such as walls, vertical surfaces of drop-off edges, doors, and window frames. In an embodiment, the dimensions of the keyholes 110 may be varied to engage with different fasteners. The keyholes 110, and the apertures 108 are symmetric about the center of the guard rail post 100. This ensures in easy handling of the guard rail post 100 as a person may use guard rail post 100 in any orientation. Thus, the guard rail post 100 is reversible in use. In an embodiment, the guard rail post 100 is made of steel or aluminum for high durability. In another embodiment, the guard rail post 100 may be made of high tensile strength plastic, galvanized steel, coated iron, fiber glass, spun fiber, polyvinyl chloride, or wood. The guard rail post 100 may be galvanized to avoid rusting.

Figure 2A:
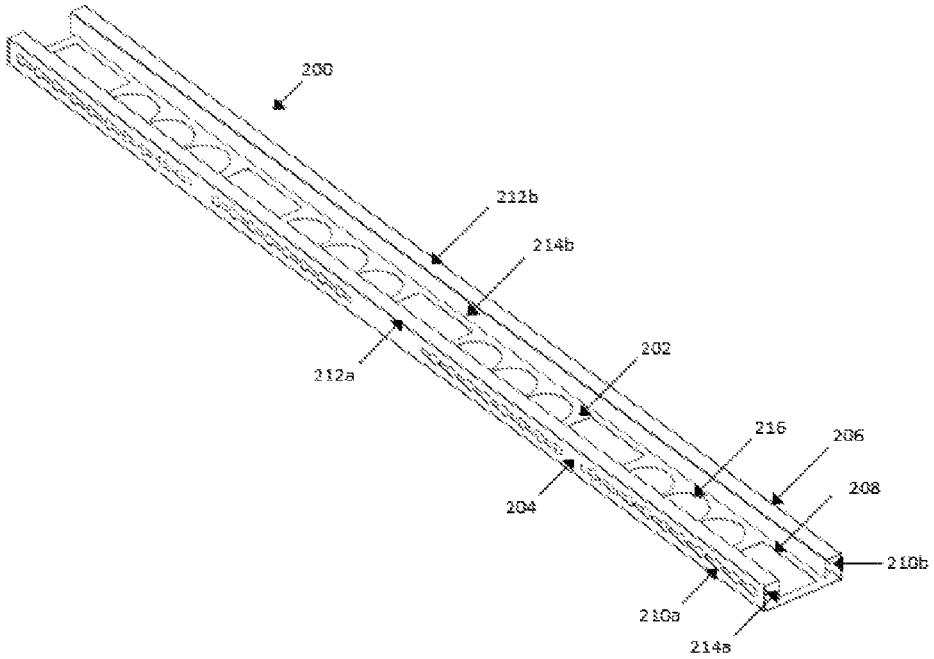
FIG. 2A is an isometric view of the guard rail post, in accordance with an embodiment of the present invention.

FIG. 2A illustrates an isometric view of a guard rail post 200 in accordance with an embodiment of the present invention. The guard rail post 200 includes a support plate 202, and first and second post mounts 204 and 206. A set of apertures 208 is formed on the support plate 202. First and second keyholes 210*a* and 210*b* are formed on the first and second post mounts 204 and 206, respectively. The guard rail post 200 further includes first and second anti-twist return supports 212*a* and 212*b*, and first and second anti-twist lip supports 214*a* and 214*b*. The support plate 202, the first and second post mounts 204 and 206, the first and second anti-twist return supports 212*a* and 212*b*, and the first and second anti-twist lip supports 214*a* and 214*b* of the guard rail post 200 are structurally and functionally similar to that of the guard rail post 100.

Figure 2B:
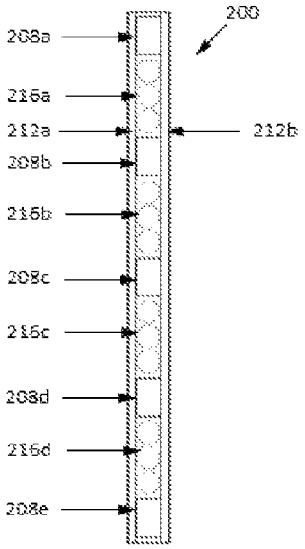
FIG. 2B is a rear view of the guard rail post, in accordance with an embodiment of the present invention.

FIG. 2B illustrates a rear view of the guard rail post 200, in accordance with an embodiment of the present invention. Each aperture of first through fifth apertures 208*a*-208*e* may receive one or more guard rails. The support plate 202 has first through fourth sets of lightening holes 216*a*-216*d* formed thereon. In an embodiment, each set of lightening holes 216 includes three lightening holes that are spaced apart from each other. For example, the first set of lightening holes 216*a* is formed between the first and second apertures 208*a* and 208*b*, and so on. The first through fourth sets of lightening holes 216*a*-216*d* are formed on the support plate 202 to reduce the weight of the guard rail post 200 without impacting its strength or integrity. In various embodiments, the lightening holes 216 may be flared or may have straight cut edges.

Figure 2C:
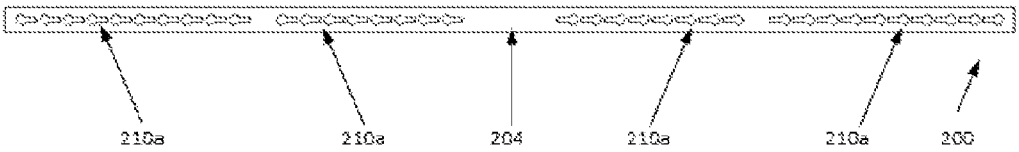
FIG. 2C is a side view of the guard rail post, in accordance with an embodiment of the present invention.

FIG. 2C illustrates a side view of the guard rail post 200 with the first plurality of keyholes 210*a* in accordance with an embodiment of the present invention. The keyholes 210*a* and 210*b* (not visible) allow the installation of the guard rail post 200 on a flat surface. The guard rail post 200 is vertically mounted on the flat surface when a keyhole 210 engages with a fastener attached to the flat surface. This arrangement allows one of the first and second post mounts 204 and 206 to be in contact with the flat surface and secures the guard rail post 200 to the flat surface at ease.

Figure 3A:
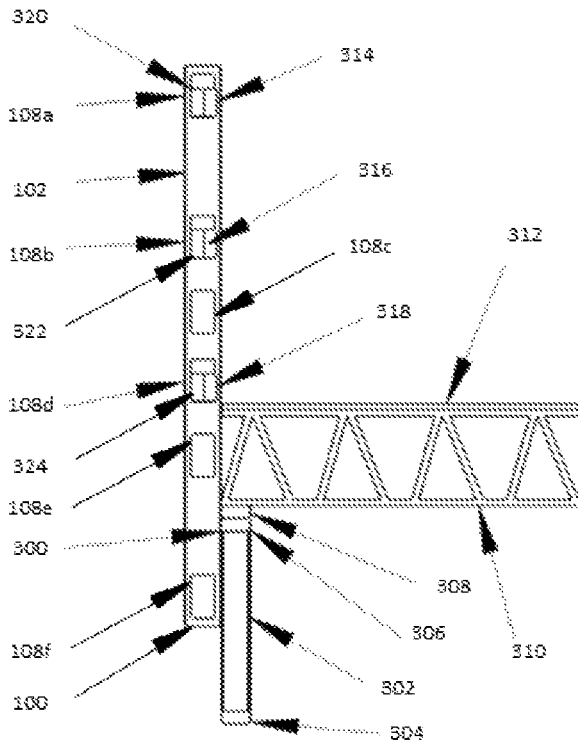
FIG. 3A is a side view of the guard rail post mounted on a floor joist or floor truss, in accordance with an embodiment of the present invention.
Figure 3B:
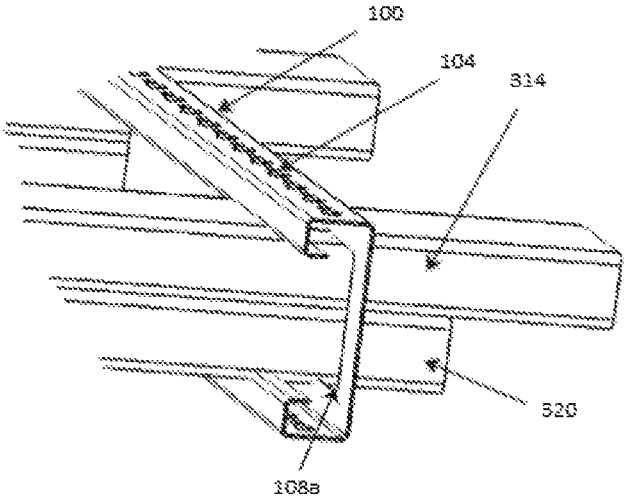
FIG. 3B is an isometric view of arrangement of a top anti-twist block in the guard rail post, in accordance with an embodiment of the present invention.

FIG. 3A illustrates a side view of the guard rail post 100 mounted on a floor joist or floor truss, in accordance with an embodiment of the present invention. The guard rail post 100 is mounted on a flat surface of the floor joist or truss. The floor joist or truss includes a stud 302 that rests between a bottom plate 304 and a top plate 306. A topmost plate 308 rests on the top plate 306 to support a floor truss or a joist 310 that supports a subfloor deck 312. A method for securing the guard rail post 100 to the wall stud 302 includes fastening the set of fasteners to the flat surface of the wall stud 302, positioning each of the set of fasteners corresponding to position of a keyhole of the first plurality of keyholes 110*a*, and engaging the keyhole with the corresponding fastener. This allows the first post mount 104 to be in contact with the flat surface of the wall stud 302. In an embodiment, the second post mount 106 is in contact with the flat surface of the wall stud 302 when the keyholes 110*b* are engaged with the set of fasteners. In a preferred embodiment, common nails or nails with rivet heads, which are typically found on construction sites, are used. The weight of the guard rail post 100 is supported by the set of fasteners. It is noteworthy that the present invention is used with common tools found on construction sites and used by construction workers; tools such as hammers, common nails and screws.

The first, second, and fourth apertures 108*a*, 108*b*, and 108*d* receive a top guard rail 314, a middle guard rail 316, and a bottom guard rail 318, respectively. The top, middle, and bottom guard rails 314, 316, and 318 are railings of the safety rail system that prevent the person from falling off of the edges of the elevated surface. Further, a top anti-twist block 320, a middle anti-twist block 322, and a bottom anti-twist block 324 are provided in the first, second and fourth apertures 108*a*, 108*b*, and 108*d*, respectively to prevent twisting or turning of the top, middle, and bottom guard rails 314, 316, and 318, respectively. Similar anti-twist blocks may be provided in all apertures 108 that run throughout the length of the safety rail. The top, middle, and bottom anti-twist blocks 320, 322, and 324 secure the top, middle, and bottom guard rails 314, 316, and 318 in the first, second, and fourth apertures 108*a*, 108*b*, and 108*d*, respectively. The first and second anti-twist return supports 112*a* and 112*b*, and first and second the anti-twist lip supports 114*a* and 114*b* provide support to the top, middle, and bottom guard rails 314, 316, and 318 and the top, middle, and bottom anti-twist blocks 320, 322, and 324. The top anti-twist block 320 holds the top guard rail 316 from twisting in the first aperture 108*a* as illustrated in FIG. 4C. In an embodiment, according to safety regulations of most jurisdictions, the top guard rail 314 is 39 to 45 inches above a working level to which the railings has to be affixed. In another embodiment, according to safety regulations of most jurisdictions, the top and middle guard rails 314 and 316 are 1.5 inches by 3.5 inches in dimension and the bottom guard rail 318 is 3.5 inches by 3.5 inches in dimension.

Figure 4A:
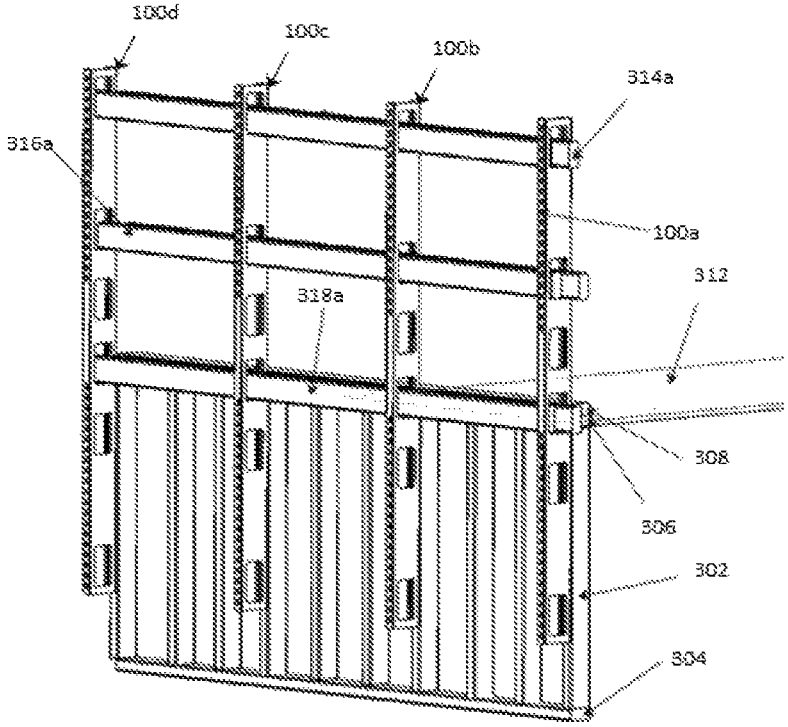
FIG. 4A is an isometric view of a safety rail system formed by installation of multiple guard rail posts on the short knee wall, in accordance with an embodiment of the present invention.

FIG. 4A illustrates a safety rail system formed using first through fourth guard rail posts 100*a*-100*d* that are mounted on a first stud wall. The first stud wall includes the wall stud 302 that rests between the bottom plate 304 and the top plate 306. The topmost plate 308 rests on the top plate 306. The first through fourth guard rail posts 100*a*-100*d* are mounted on the flat surface of the wall stud 302. A top guard rail 314*a*, a middle guard rail 316*b*, and a bottom guard rail 318*a* are secured in corresponding apertures of and secured by the first through fourth guard rail posts 100*a*-100*d*. A first top anti-twist block 320*a* is provided in aperture of the guard rail post 100*a* to prevent twisting of the first top guard rail 314*a*. In this application, the safety rail of the present application is installed before the joists, or floor trusses are installed. This provides fall protection at the leading edge for the person installing the joist or floor truss.

Figure 4B:
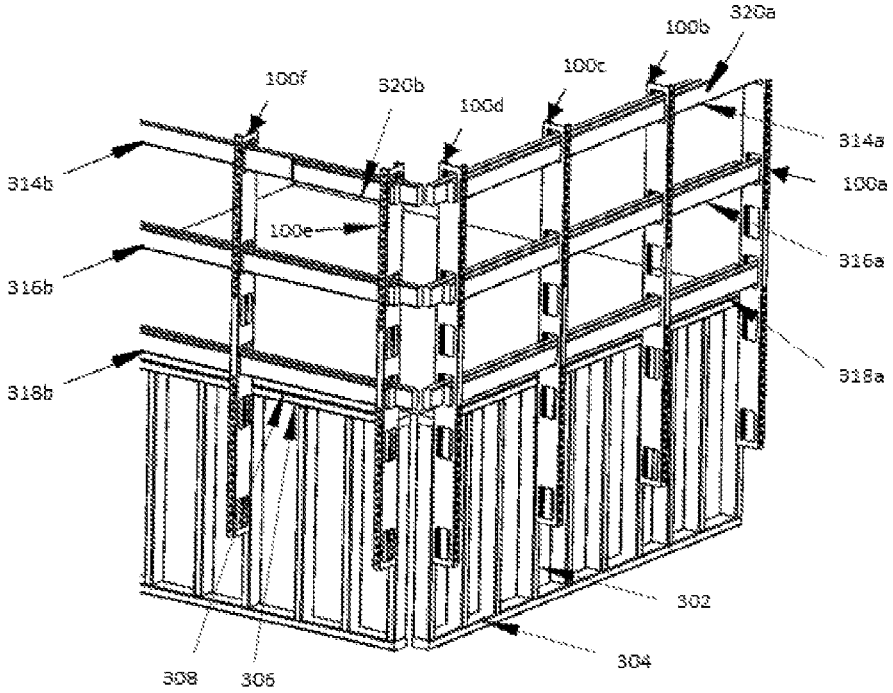
FIG. 4B is an isometric view of the safety rail system formed by installation of multiple guard rail posts on multiple short knee walls, in accordance with an embodiment of the present invention.
Figure 4C:
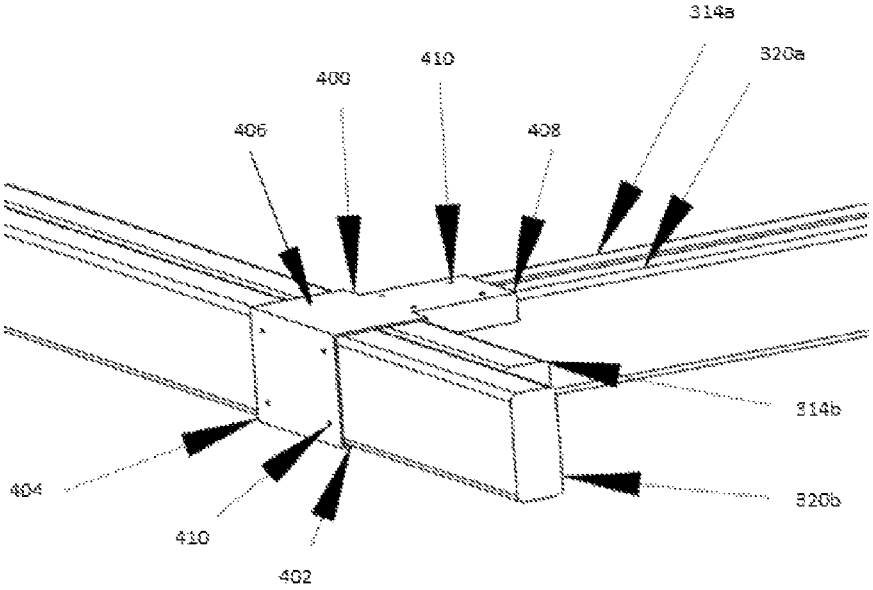
FIG. 4C is an isometric view of a corner bracket utilized in the safety rail system, in accordance with an embodiment of the present invention.

FIG. 4B illustrates the safety rail system formed using guard rail posts 100*a*-100*f* mounted on two perpendicular stud walls. The guard rail posts 100*a*-100*d* are mounted on the first stud wall, while the guard rail posts 100*e*-100*f* are mounted on the second short stud wall to form the safety rail system. A top guard rail 314*b*, a middle guard rail 316*b*, and a bottom guard rail 318*b* are received into corresponding apertures of the guard rail posts 100*e* and 100*f*. A second top anti-twist block 320*b* is provided in aperture of the guard rail post 100*e* to prevent twisting of the second top guard rail 314*b*. The guard rail posts 100*d* and 100*e* are positioned near corner of the safety rail system. It will be obvious to those of skill in the art, such as contractors that not all safety rails would be needed in all cases. It is possible to use the bottom guard rail, or just the top guard rail depending on need of protection from objects which can be kicked out of a doorway, or window opening. Further, corner brackets may be used to connect the guard rails at right angles.

FIG. 4C illustrates use of a corner bracket 400 between first and second top guard rails 314*a* and 314*b*, in accordance with an embodiment of the present invention. The corner bracket 400 connects the first and second top guard rails 314*a* and 314*b*, and the first and second top anti-twist blocks 320*a* and 320*b* that intersect at a junction. The corner bracket 400 provides rigidity to the first and second top guard rails 314*a* and 314*b*. The corner bracket may or may not be required and generally serves to connect guard rails that intersect at an outside or inside corner, or junction, to provide a measure of rigidity. The corner bracket 400 includes a bottom flange 402, a side bracket 404, a top bracket 406, and a set of side flanges 408. The corner bracket 400 is secured to the first and second top guard rails 314*a* and 314*b* using fasteners 410. For an example, eight fasteners are shown on the corner bracket 400.

Figure 5:
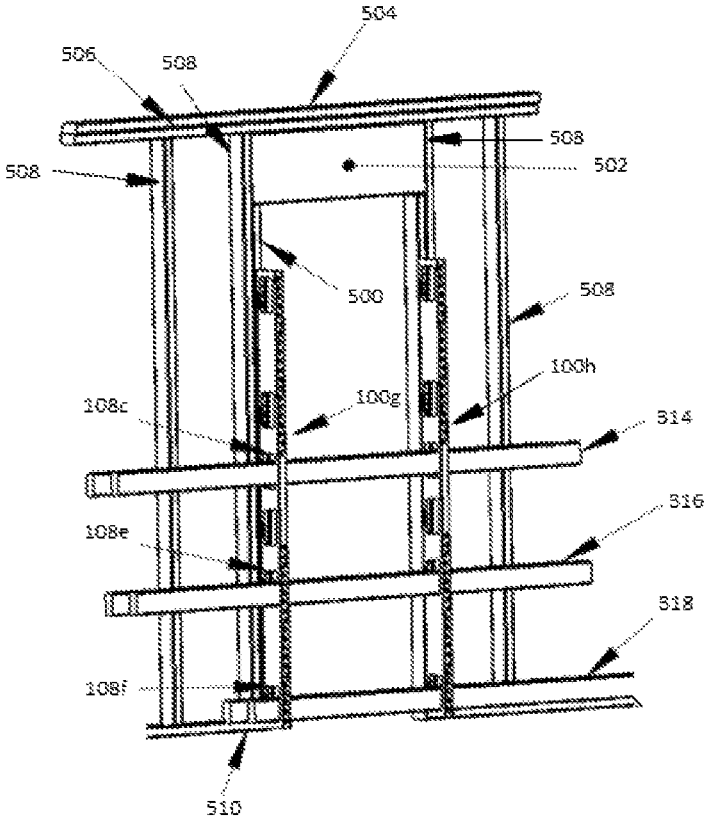
FIG. 5 is an isometric view of multiple guard rail posts installed at a door opening, in accordance with an embodiment of the present invention.

FIG. 5 illustrates the use of guard rail posts 100*g* and 100*h* across a door opening (or window opening) 500, in accordance with an embodiment of the present invention. The guard rail posts 100*g* and 100*h* are mounted on a framing structure of the door opening 500 having a header 502. The framing structure includes a topmost plate 504 that rests on a top plate 506. A wall stud 508 is secured between the top plate 506 and a bottom plate 510. The guard rail posts 100*g* and 100*h* are mounted on the wall stud 508. The top, middle, and bottom guard rails 314, 316, and 318 are arranged in the corresponding apertures of the guard rail posts 100*g* and 100*h*, and prevent workers from falling through the door opening 500.

Figure 6:
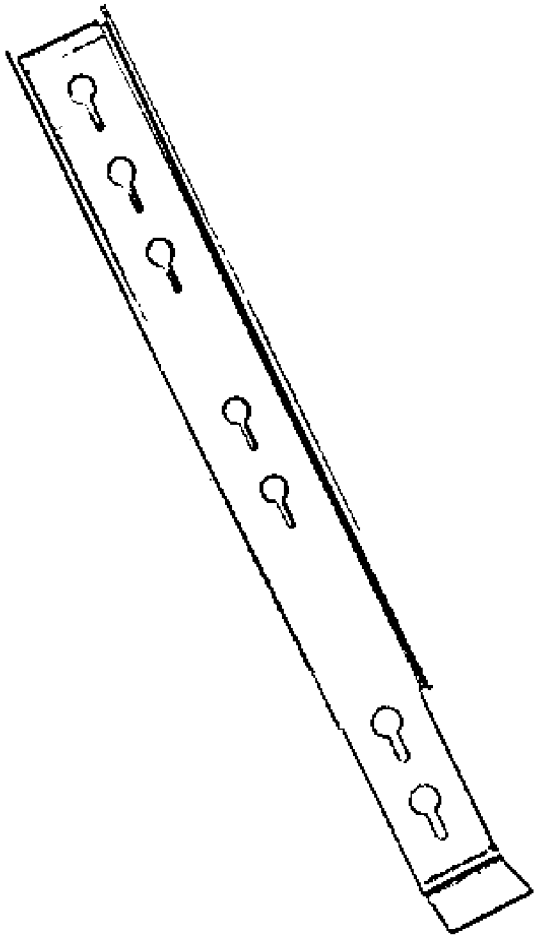
FIG. 6 illustrates nailing jigs used for the purpose of setting up fasteners that are used for securing the guard rail post, in accordance with an embodiment of the present invention.

FIG. 6 illustrates nailing jigs used for the purpose of setting up nails on the flat surface that are used for securing the guard rail post 100 in accordance with the embodiment of the present invention. The nailing jigs are used by the construction workers during installation of the guard rail posts 100 to ensure that nails are spaced at appropriate distance as required.

The guard rail post 100 is simple to install as it slides onto the set of fasteners using the keyholes 110. Further, the guard rail post 100 locks onto the set of fasteners due to the weight of the guard rail post and the keyholes 110. Therefore, a person can install the guard rail post 100 without having to lean over or kneel down at edges of the elevated surface, making the guard rail post 100 safer to install. The guard rail post 100 can be installed using the nailing jigs, a hammer, and nails. These are readily available for any construction worker. Further, the guard rail post 100 can be removed safely from a standing position typically in generally under 30 seconds. An advantage of the guard rail post 100 is the ease of removal of the guard rails. The fasteners can be leveled-off with a surface with a few hammer blows after disassembling the guard rail post 100, thereby allowing the sheathing to be installed without any damage to the surface. The guard rail post 100 can be installed before raising a wall. The simple design of the guard rail post 100 makes the guard rail post 100 light-weight. Thus, mounting of multiple guard rail posts to the wall entails less strain. The guard rail posts can be mounted on the wall before raising the wall, thereby reducing the amount of time and effort required by the worker. The simple design of the guard rail post 100 prevents damage to the guard rails while disassembling the guard rail post 100 from the flat surface. Hence, the guard rails can be reused for setting up the safety rail system. This reduces the material cost of the safety rail system that utilizes the guard rail post 100.

The guard rail post 100 can be a monolithic structure. The guard rail post 100 is easy to store, light-weight, and symmetric, so that bottom end can be used as top end and vice versa. The guard rail post 100 is easy to be assembled and disassembled from any surface. This reduces the time and labor cost for installation and removal of the guard rail post 100. Even when one or more apertures 108 and keyholes 110 are damaged, the guard rail post 100 can still be used. This is achieved due to the symmetric design of the guard rail post 100. The keyholes allow easy installation and faster removal. The layout of the keyholes allows quick and intuitive placement of the posts in either a stud wall configuration, or after the joists are installed. This design allows fast installation without need of measuring devices. Finally, the installation can be done using common tools and common nails easily found at all construction sites.

The present invention has been described herein with reference to a particular embodiment for a particular application. Although selected embodiments have been illustrated and described in detail, it may be understood that various substitutions and alterations are possible. Those having an ordinary skill in the art and access to the present teachings may recognize additional various substitutions and alterations are also possible without departing from the spirit and scope of the present invention, and as defined by the following claims.

What is claimed is:

1. A guard rail post, comprising:

a longitudinally extending support plate;

a first post mount, wherein the first post mount perpendicularly extends from a first side of the support plate and includes a plurality of keyholes formed thereon; and a second post mount, wherein the second post mount perpendicularly extends from a second side of the support plate and includes a plurality of keyholes formed thereon, wherein the first and second post mounts extend longitudinally throughout a length of the support plate, wherein the support plate includes at least one aperture formed thereon, wherein, in operation, the guard rail post is mounted on a flat surface, such that at least one keyhole of at least one of the first and second post mounts engages with at least one fastener attached to the flat surface, whereby at least one of the first and second post mounts is in contact with the flat surface, and at least one guard rail is received in the at least one aperture formed on the support plate.

2. The guard rail post of claim 1 further comprising first and second anti-twist return supports extending perpendicularly and inwardly form the first and second post mounts.

3. The guard rail post of claim 1 further comprising first and second anti-twist lip supports extending perpendicularly and inwardly from the first and second anti-twist return supports, respectively, for providing support to the at least one guard rail.

4. The guard rail post of claim 1, wherein at least one aperture is rectangular in shape.

5. The guard rail post of claim 1, wherein the guard rail post is made of at least one of steel, aluminum, wood, and plastic.

6. The guard rail post of claim 1 mounted vertically.

7. The guard rail post of claim 1 mounted horizontally.

8. The guard rail post of claim 1 further including a nail jig used to secure at least one nail on the flat surface.

9. A guard rail post, comprising:

a longitudinally extending support plate;

a first post mount, wherein the first post mount perpendicularly extends from a first side of the support plate and includes a plurality of keyholes formed thereon;

a second post mount, wherein the second post mount perpendicularly extends from a second side of the support plate and includes a plurality of keyholes formed thereon;

first and second anti-twist return supports extending perpendicularly and inwardly from the first and second post mounts; and first and second anti-twist lip supports extending perpendicularly and inwardly from the first and second anti-twist return supports, wherein the first and second post mounts extend longitudinally throughout a length of the support plate, wherein the support plate includes at least one aperture formed thereon.

10. The guard rail post of claim 9 wherein in operation, the guard rail post is mounted on a flat surface, such that at least one keyhole of at least one of the first and second post mounts engages with at least one fastener attached to the flat surface, whereby at least one of the first and second post mounts are in contact with the flat surface, and at least one guard rail is received in the at least one aperture formed on the support plate.

11. The guard rail post of claim 10 further including a nail jig used to secure at least one nail on the flat surface.

12. The guard rail post of claim 9, wherein at least one aperture is rectangular in shape.

13. The guard rail post of claim 9, wherein the guard rail post is made of at least one of steel, aluminum, wood, and plastic.

14. The guard rail post of claim 9 mounted vertically.

15. The guard rail post of claim 9 mounted horizontally.

* * * * *